United States Patent [19]

Spanel

[11] 3,996,663

[45] Dec. 14, 1976

[54] HAIR CUTTERS

[76] Inventor: Abram N. Spanel, 344 Stockton St., Princeton, N.J. 08540

[22] Filed: July 1, 1974

[21] Appl. No.: 484,566

[52] U.S. Cl. ..... 30/30; 132/11 R

[51] Int. Cl.[2] ..... B26B 21/12

[58] Field of Search ..... 30/30, 31, 53, 54, 55, 30/74.1, 82, 47; 132/11 R, 126, 128, 141, 138

[56] References Cited

UNITED STATES PATENTS

| | | | |
|---|---|---|---|
| 2,716,809 | 9/1955 | Malone | 30/30 |
| 2,718,693 | 9/1955 | Gent | 30/31 |
| 2,731,717 | 1/1956 | Spanel | 30/31 |
| 3,724,070 | 4/1973 | Dorion | 30/47 |

*Primary Examiner*—Gary L. Smith
*Attorney, Agent, or Firm*—Steele & Petock

[57] ABSTRACT

Hair cutters having a hair cutting blade laterally adjustable to selectable hair cutting positions within a cage of wire tines including substantial improvements in cage and frame construction. In one embodiment, the cage is longitudinally slidable relative to the blade carrier to provide access to the blade for replacement purposes while in a second embodiment, the blade and its retaining means are longitudinally slidable from within the cage.

12 Claims, 15 Drawing Figures

HAIR CUTTERS

BACKGROUND OF THE INVENTION

1. Field of the Invention

The subject invention relates to hair cutters for use at home and elsewhere which may be safely used by men, women and children for hair cutting, trimming and/or grooming. The subject invention has particular utility when modern hair styling techniques are employed and precise blade control is an important requirement.

2. Prior Art

In U.S. Pat. No. 2,731,717, Abram N. Spanel, a co-inventor of the subject invention, disclosed various embodiments of a hair cutter which two decades ago were a commercial success. However, in today's society, with ever increasing emphasis placed on consumer protection, the safety of such a hair cutter has become of critical importance and must receive as much attention as the operability of the device. Furthermore, current difficulties of acquiring certain materials require modifications consistent with providing a durable product.

The preferred embodiment of aforementioned U.S. Pat. No. 2,731,717, included a cage formed by a plurality of tines within which was located a laterally adjustable cutting blade. The blade was adjusted by means of a thumb wheel which was carried by the handle portion of the cutter.

In the preferred embodiment of U.S. Pat. No. 2,731,717, as shown in FIG. 2, a gap was provided in the tines, between clamp plates 31 ad 32, to allow access for blade changing purposes. To accomplish this, a clamping element had to be unlatched and the blade physically guided through the gap in the cage. The task of inserting the new blade was complicated by the restricted finger space around the clamping means and considerable dexterity was required to properly secure the blade. Handling blades under these circumstances created a safety hazard that detracted from the appeal of the device.

While FIG. 6 of the aforementioned U.S. Pat. No. 2,731,717 disclosed a removable cage, which was intended to lessen the difficulty of blade changing, the effect was to increase danger by permitting the blade to be completely exposed in a mounted condition making accidental contact, including a sliceable contact with one of the cutting edges a distinct possibility. The cutting device of FIG. 6 was considered to not provide adequate safety for commercial production when the original commercial embodiment was selected and today's safety standards further lessen the attractiveness of that particular device.

In U.S. Pat. No. 3,855,696, an improved hair cutter is disclosed in which safety requirements are properly and humanely emphasized. Longitudinal movement of either the blade carriage or the cage is provided to eliminate the necessity of reaching inside of the cage to clamp and unclamp the blade. Regardless of whether the cage is moved to expose the blade carrier or the blade carrier is slid longitudinally to extend outwardly of the cage, a shielding member 16*a* occupies a central position and is dimensionally wider than the cutting blade, thus preventing injurious contact with its cutting edge or edges when the blade is in its centered position. The relative logitudinal movement between cage and blade carrier is permitted by a safety mechanism only when the blade is in its shielded position. In one embodiment, structure is disclosed to prevent accidental lateral shifting of the blade and its cutting edge or edges away from its shielded position when the cage is removed; and only by replacing the cage can further lateral adjustment of the blade occur.

In Ser. No. 450,581, which is a continuation-in-part application of U.S. Pat. No. 3,855,696, a further modified embodiment is disclosed. The cage is supported in such manner as to be longitudinally adjustable to expose the blade for unobstructed access thereto, thus facilitating blade changing without complete removal of the cage. This modification eliminates the need to rejoin the cage to the frame, which might prove perplexing to some users, such as those who are accident-prone.

While these recent disclosures provide distinct advantages over the earlier models, due consideration of current manufacturing problems has resulted in further invention, disclosed herein, in which simplicity without sacrifice of improved safety features becomes possible, thus meeting requirements for a successful commercial embodiment.

SUMMARY OF THE INVENTION

In accordance with the subject invention, the basic Spanel hair cutter design has been improved and a simplified construction has been utilized to facilitate manufacture and provide the consumer with operational advantages. Also, additional safety features in blade changing have been incorporated.

An important consideration in hair cutter construction is the necessity of imparting rigidity to the tines while minimizing their diameter. This goal may be accomplished simultaneously with that of a preferred manufacturing method by utilizing a new type frame and an upper spine which maintains its rigidity by being integral with other frame structure.

In one embodiment, the cage may be longitudinally slidable with respect to the remainder of the frame to facilitate blade replacement. In a further embodiment, the blade carrier is provided with structure along which the blade and its clamping means may be longitudinally guided and completely removed from the remainder of the hair cutter structure, including the cage. The blade, which may be molded to the clamping means thus forming a disposable unit, is readily accessible to facilitate removal and replacement. Also included is a motion-multiplying means which permits increased lateral motion of the blade carrier and blade.

DETAILED DESCRIPTION

Figure 1:
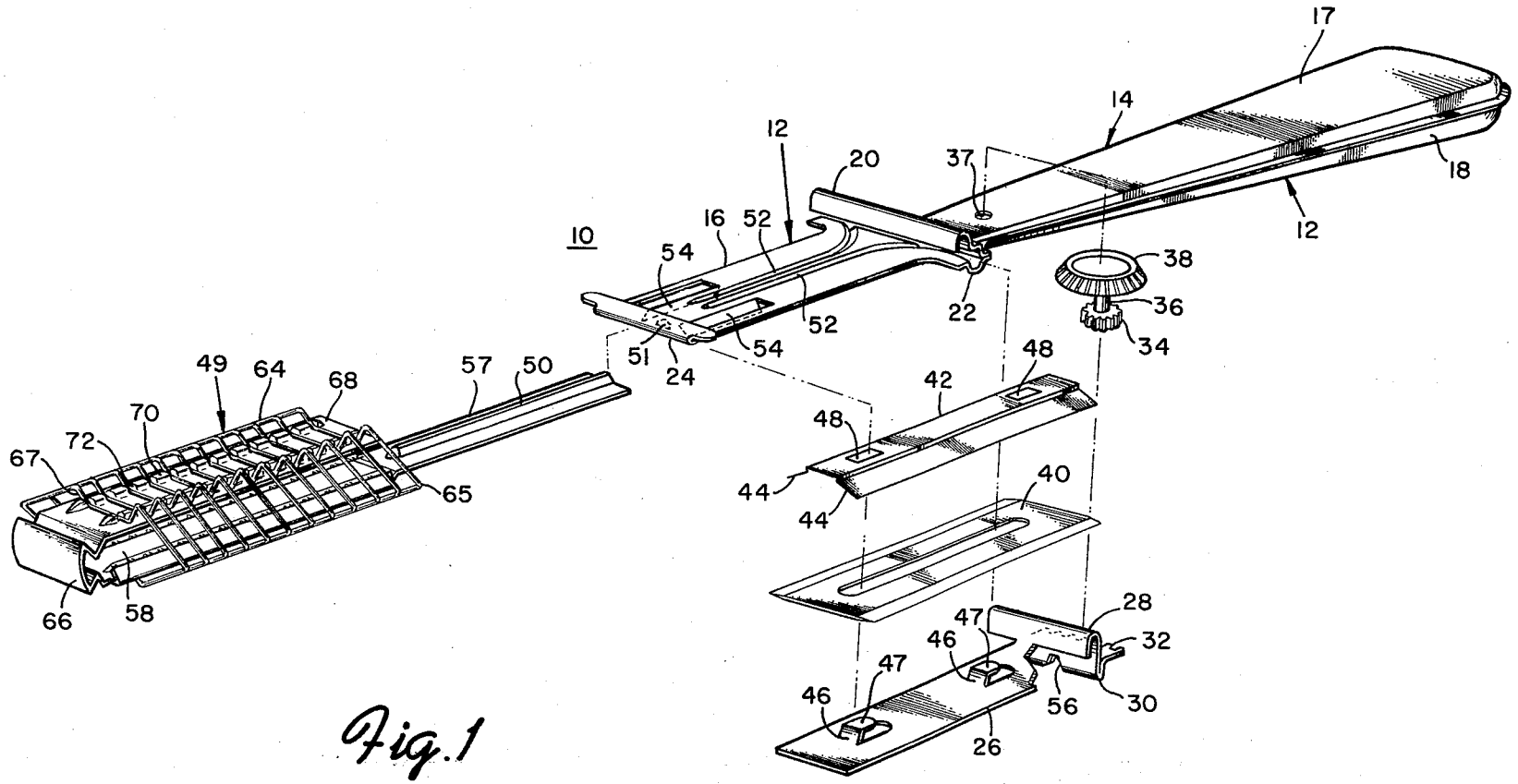
FIG. 1 is an exploded isometric view in which the cage and a portion of the frame are longitudinally slidable to provide unobstructed access to the blade.
Figure 2:
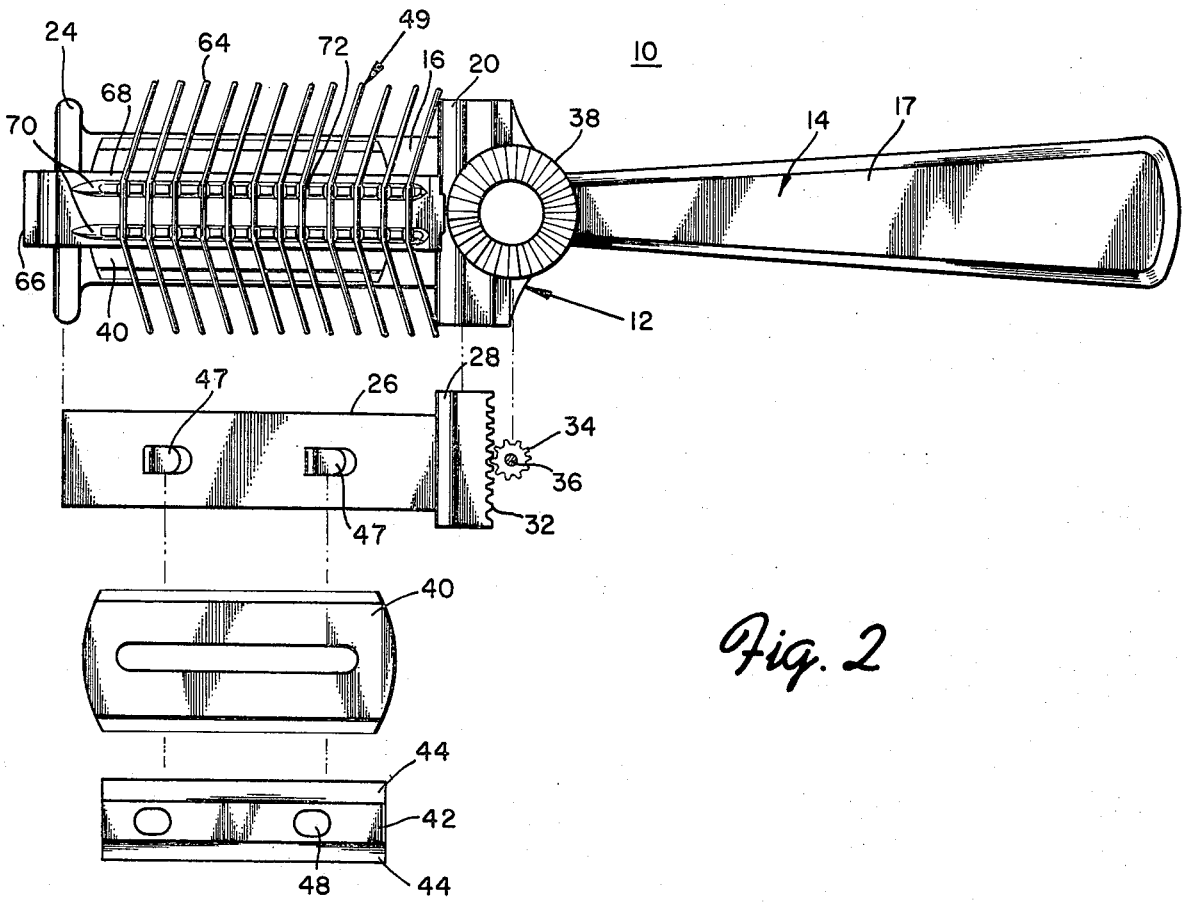
FIG. 2 is a top view of a hair cutter, which is similar to that shown in FIG. 1, however, modified to include angulated tines.
Figure 3:
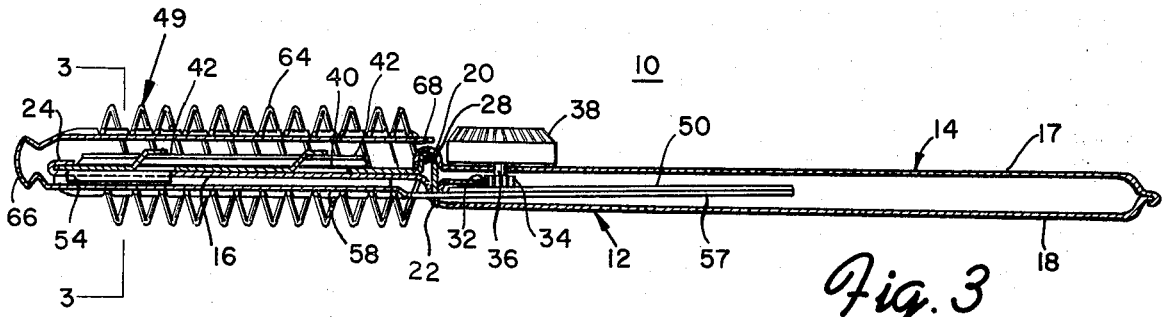
FIG. 3 is a side elevation of the hair cutter of FIG. 2, with components assembled.

With reference to the drawings, a first embodiment of the invention is shown in FIGS. 1 through 4 comprising a hair cutter 10 having a frame 12 which includes handle 14 and blade table 16. The handle 14 is shown comprising a top portion 17 and a bottom portion 18 which are crimped or otherwise secured together. The top portion 17 terminates in an upper bearing support 20 while the lower portion 18 forms lower bearing support 22 and blade table 16, the latter of which terminates in guideway 24, (see FIGS. 1 and 3).

A blade carrier 26 is provided with upper and lower bearing surfaces 28 and 30 respectively which are complementary and in sliding engagement within the continuous guideway channels formed by upper and lower bearing supports 20 and 22, respectively. The blade carrier 26 terminates in a gear rack 32 which serves as a driven gear for a driving gear which is pinion 34. A shaft 36 extends through aperture 37 and is rigidly secured to pinion 34 and thumb knob 38. By rotating thumb knob 38, lateral movement is thus imparted to the blade carrier 26, with its end slidable within guideway 24.

A cutting blade 40 is securable to carrier 26 and is preferably a standard double edged blade. It is clamped to the carrier 26 by blade clamp plate 42 having depending sides 44 which when under stress provide resilient clamping of the blade against the blade carrier 26. Clamp studs 46 of carrier 26 have flanged heads 47 to engage slots 48 of the clamp 42, to secure the blade firmly in place on the blade carrier 26.

A blade cage 49 comprises upper and lower spines 68 and 58, respectively, which are formed from a single piece of material with the lower spine 58 terminating in an extension 57. The blade cage 49 further comprises wire tines 64 which are shaped to form oppositely disposed apexes 65 and define generally right and left sides of the hair cutter 10. It will be noted that the tines 64 have inwardly bent portions 67 to permit the hair to pass through the cage without being pressed down by either the upper or lower spines 68, 58, respectively.

Figure 4:
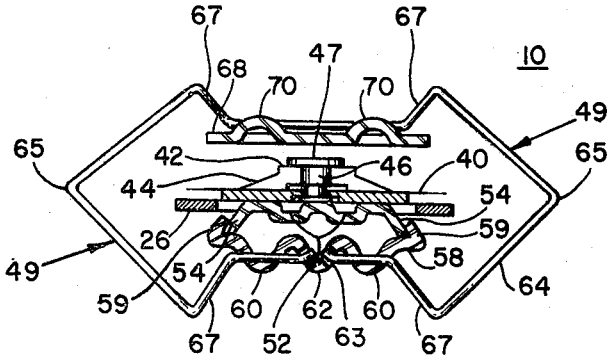
FIG. 4 is a cross-sectional view taken along the lines 3—3 of FIG. 3.

As shown in FIG. 4, lower spine 58 is shown having outer staking ribs 60 and a center staking rib 62, all of which have crosswise staking slots to receive the wire tines 64. In this embodiment, each tine 64 is shown terminating at the center staking rib 62 with each of the tine ends turned slightly into the holes 63 within the staking rib 62. A pull tab 66 (FIG. 1) is formed from lower and upper spines 58 and 68, respectively. The upper spine 68 is shown having two parallel staking ribs 70 with crosswise slots 72 into which the wire tines 64 are inserted. The tines 64 may be secured by staking, welding or brazing into both the upper and lower spines 58 and 68, respectively.

With further reference to FIGS. 1 and 4, the blade table 16 has a pair of stiffening ribs 52 formed therein and male components 54 of a dovetail slide are cut and and pressed to depend downwardly. The lower spine 58 has the female components 59 of the dovetail slide which are compatible with the male components 54 of the blade table 16 to permit the relative longitudinal sliding of the cage 49 with respect to the remainder of the frame 12.

The extension 57 is slide into the hollow handle 14 (FIG. 3) through a slot traversing the lower bearing surface 22 (FIG. 1). An interlock ridge 50 extends upwardly along the upper surface of extension 57 and when blade carrier 26 is in a centered position, an interlock notch 56 is also centered to permit interlock ridge 50 to pass the blade carrier lower bearing surface 30. Thus, the cage 49 can be removed and replaced only when the blade carrier 26 is in its centered position where the blade 40 (FIG. 2) will be shielded from contact by the sides of blade table 16, the width of the blade table 16 being greater than that of hair cutting blade 40.

As shown in FIG. 1, a stop tab 51 may be provided to depend downwardly and engage interlock ridge 50 to prevent complete removal of the cage 49 as it is slide to an extended position, where unobstructed access is provided for blade changing purposes.

With reference to FIGS. 5 through 8, a modified embodiment of the hair cutter is shown in which the blade changing takes place without removal or movement of the cage.

Figure 7:
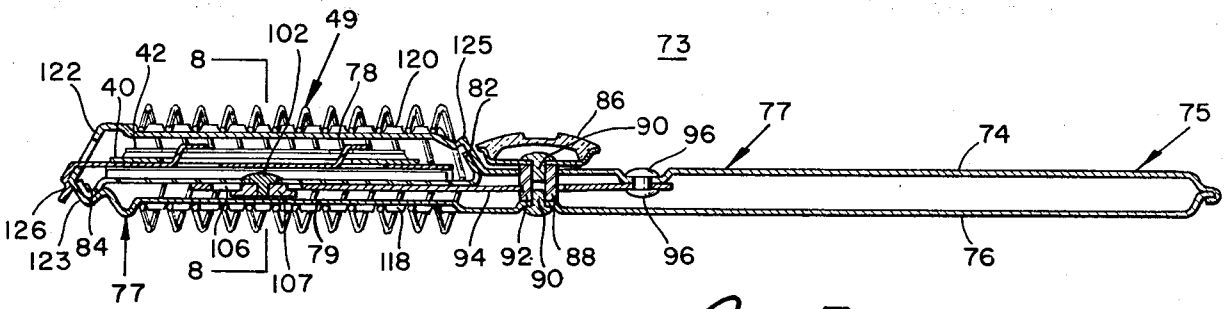
FIG. 7 is a side elevation of the hair cutter of FIG. 6.
Figure 8:
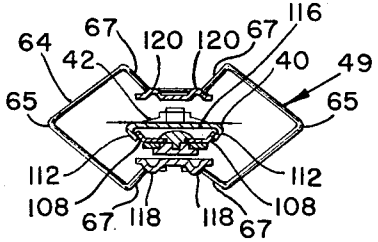
FIG. 8 is a cross-sectional view taken along the lines 8—8 of FIG. 7.

As seen in FIG. 7, the hair cutter 73 may utilize a single piece of material to form top 74 and base 76 of handle 75 as well as the upper and lower spines 78 and 79, these four members comprising the frame 77. A laterally shifting blade carrier 80 is positioned between upper and lower spines 78, 79, respectively and has a rear bearing member 82 and a forward groove-like bearing member 84 which are compatible with and slidable within bearing surfaces 125 and 123 of frame 77, respectively.

Figure 5:
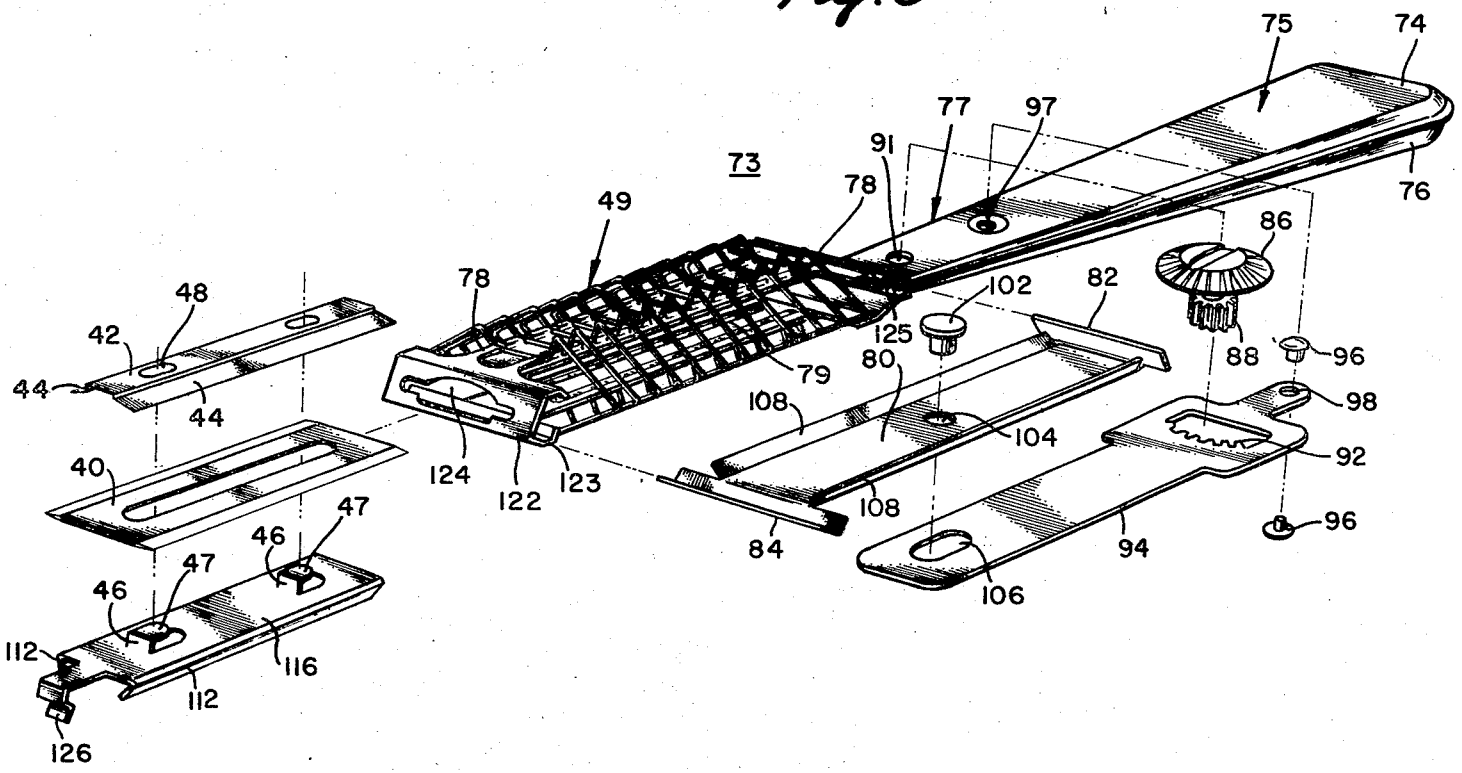
FIG. 5 is an exploded isometric view of a hair cutter embodiment in which the blade may be inserted from the end of the cutter.
Figure 6:
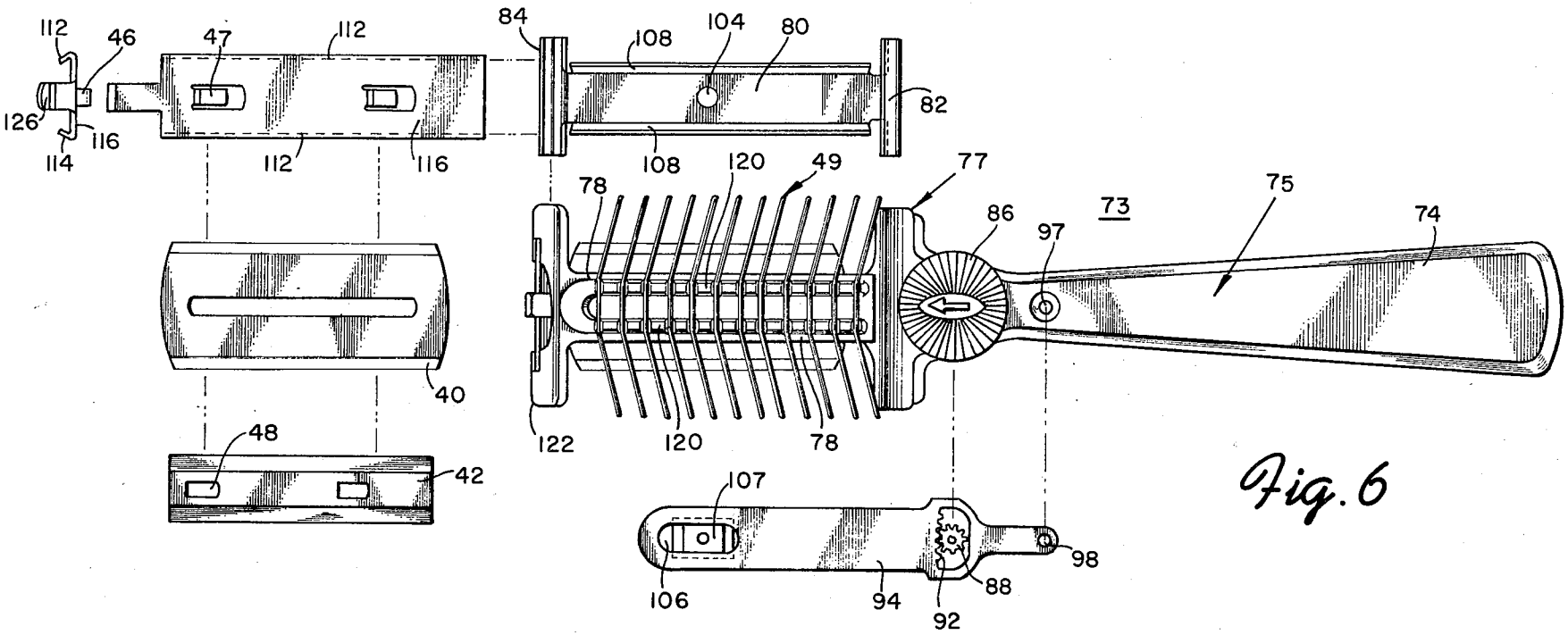
FIG. 6 is a top view of a hair cutter similar to that shown in FIG. 5.

As best seen in FIGS. 5 and 7, a thumb knob 86 is secured to a pinion 88 by means of shaft 90 (FIG. 7) which extends through aperture 91. The pinion engages a circular internal rack 92 of an adjustment lever 94 which is pivotally mounted through aperture 98 by connecting members 96 extending through aperture 97 in the top 74 of handle 75. The adjustment lever 94 is pivotally secured to the blade carrier 80 by means of connecting member 102 which extends through aperture 104 and sliding slot 106 of carrier 80 and lever 94, respectively, and is embedded in sliding block 107 (FIG. 6). It will be appreciated that by means of structure 82 and 84, the carrier 80 retains a lateral motion path which is perpendicular to the longitudinal axis of the hair cutter. Thus, the adjustment lever 94 serves as a motion enhancing means to increase the throw (lateral travel) of the blade carier 80 more than is possible by using the linear rack and pinion of the embodiment shown in FIGS. 1 to 4.

The carrier 80 (FIG. 5) has male components 108 which are compatible with female components 112 of the blade clamp support 116 to form a dovetail type sliding relationship between the carrier 80 and blade clamp support 116. The blade is mounted on the clamp support 116 in a manner similar to that used on blade carrier 26 of FIG. 1.

The wire tines 64 of cage 49 (FIG. 8) are essentially the same as shown in the earlier embodiment, however, it will be noted that the lower spine member 79 has only two staking ribs 118 (FIG. 8) and that the tines terminate just after passing through the notches in the ribs 118 instead of passing into a third rib as shown in FIG. 4. The shaped end structure 122 of the frame 77 includes a slot 124 through which the blade clamp support 116 with blade 40 and clamp 42 mounted thereon can be easily inserted. The clamp support 116 slides onto blade carrier 80 as the dovetail components 108 and 112 slidably engage one another. A pull tab 126 extends from blade clamp support 116 and remains on the exterior of the frame 77 when the blade support 116 with blade 40 are inserted into the cage 49. When it is desired to change the blade, the pull tab 126 is grasped and the blade 40 and its support 116 are easily removed, thus permitting clamp 42 to be conveniently operated for blade replacement.

Figure 10:
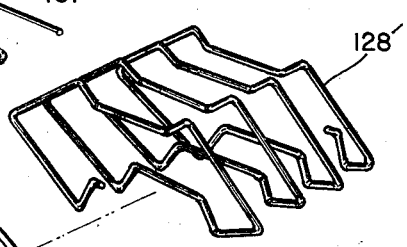
FIG. 10 shows the helical wound wire shaped into a series of tines.
Figure 9:
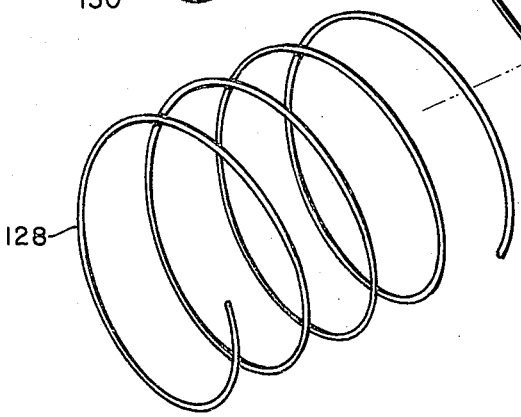
FIG. 9 is a partial top view of a hair cutter in which the tines are formed from continuously wound helical wire.
Figure 9:
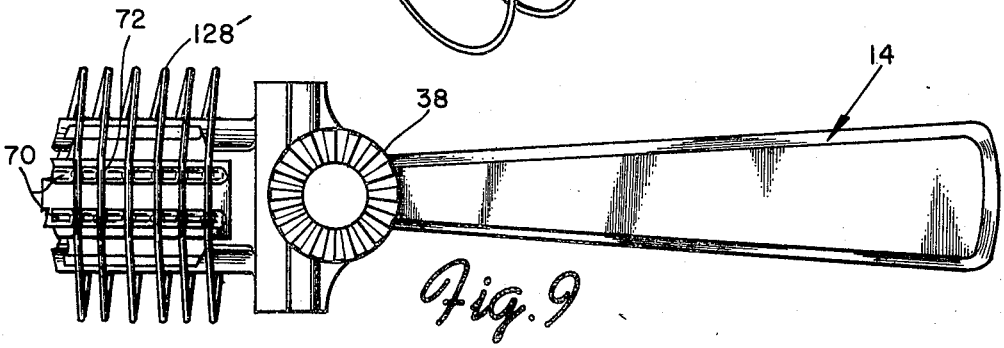

With reference to FIGS. 9 and 10, a further embodiment is shown in which a continuous helical coil wire is used in place of individual wires to form tines. As seen in FIG. 10, the helical coil 128 is shaped into tines 128′ and is secured onto the hair cutter by staking or the other means above described.

Figure 12:
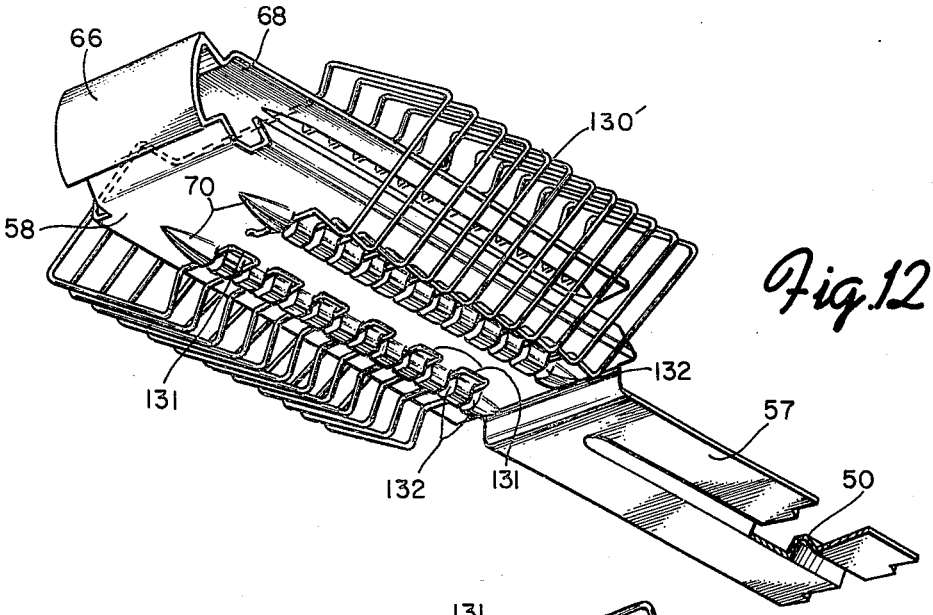
FIG. 12 shows the pre-shaped tine structure of FIG. 11 mounted on upper and lower spines of the hair cutter.
Figure 11:
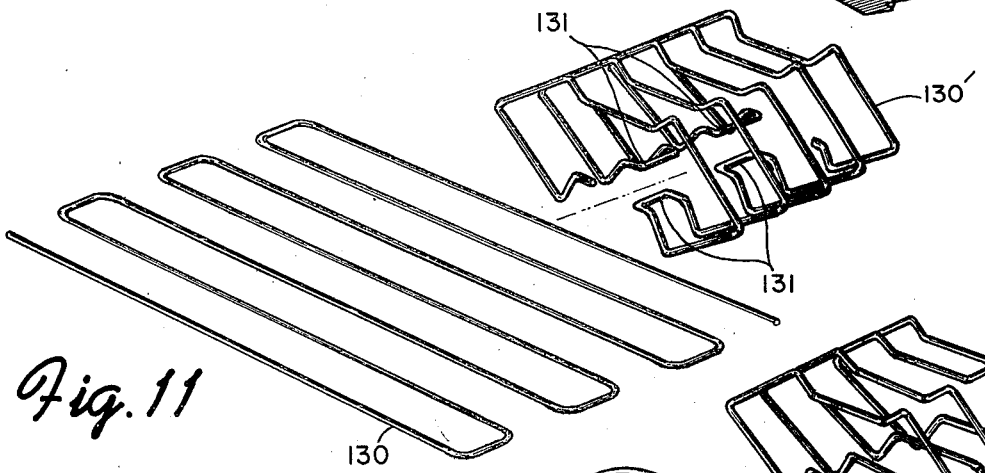
FIG. 11 shows a continuous piece of wire which can be formed into a pre-shaped tine structure shown adjacent the extended wire.

In place of the helical coil wire 128, a continuous wire piece shown as 130 in FIG. 11 may be shaped as shown into tines 130′. The tines have double 90° angle portions 131, and in FIG. 12, it will be seen that by means of crosswise notches 132 through the staking ribs 70, the shaped tines may be mounted by clamping the 90° double angle portions 131 around the nub-like portions of the staking ribs 70 which are formed by the crosswise notches 132.

In staking the tines, material of the staking rib is flowed down and around the wire of the tine to secure it within the crosswise staking notches 132. Alternatively, welding or brazing or any other suitable process may be used. While two staking ribs 70 are disclosed, it is understood that any desired number on either the upper or lower spine may be used.

Figures 13, 14, 14A:
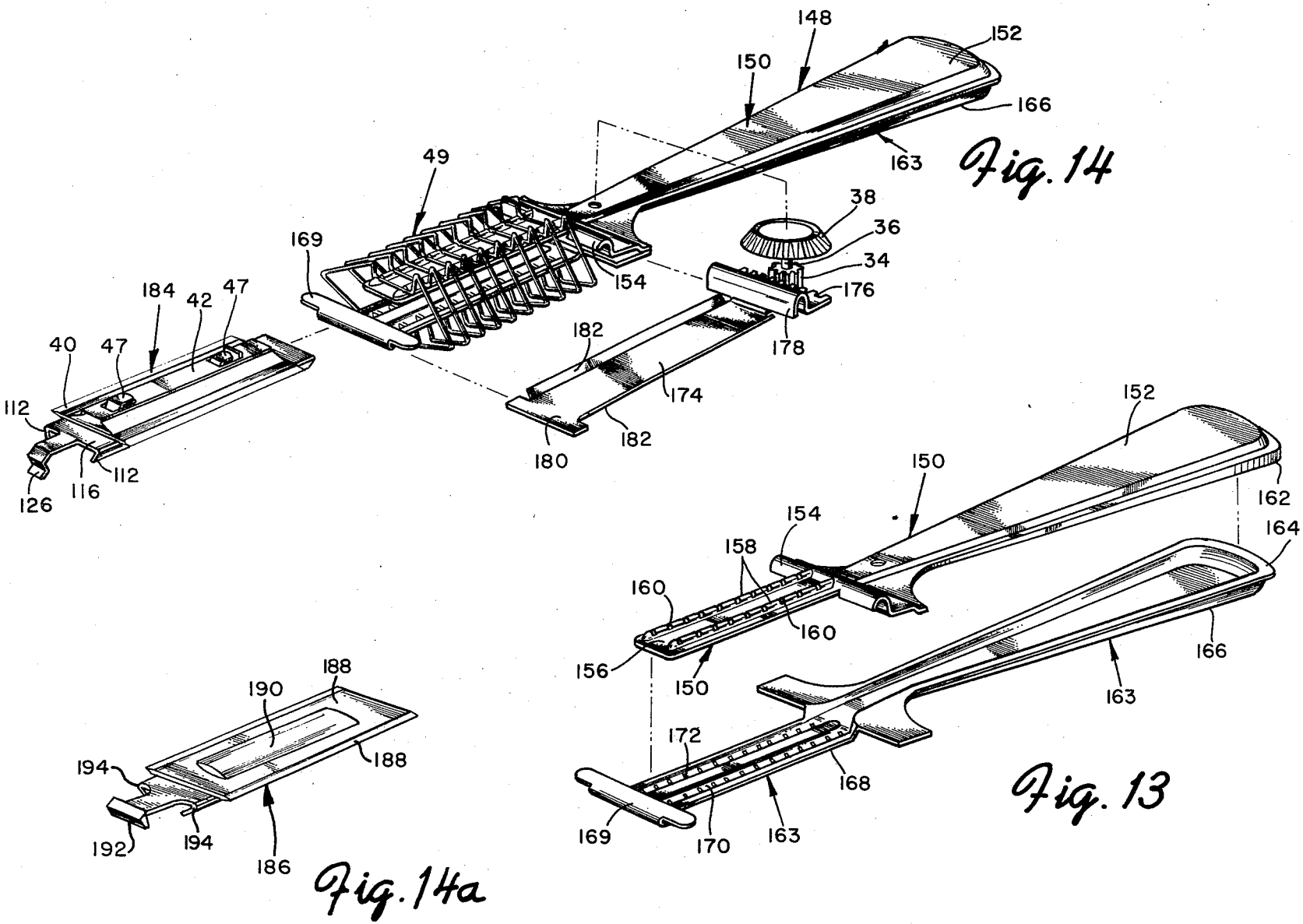
FIG. 13 shows upper and lower frame members of a further modified hair cutter.
FIG. 14 is an exploded perspective view of the hair cutter of FIG. 13.
FIG. 14*a* shows an alternate form of the blade holder.

With reference to FIGS. 13 and 14, a further embodiment of a hair cutter similar to that shown in FIG. 5, is disclosed. The upper member 150 as shown in FIG. 13 forms the upper portion 152 of handle 148 (FIG. 14), the bearing support 154 and the upper spine 156 which includes staking ribs 158 and staking notches 160 into which tines of cage 49 are inserted. The handle portion 152 (FIG. 13) includes a crimping skirt 162 which is crimped about flange 164 of the lower handle portion 166 (FIG. 13) as is shown crimped in FIG. 14. The lower member 163 also includes the lower spine 168 with staking ribs 170 and notches 172. The lower spine 168 terminates in an upturned end guideway 169 which houses the end portion 180 of the carrier 174 shown in the exploded view in FIG. 14. The carrier 174 is similar to carriage 80 shown in FIG. 5 and includes the linear gear rack 176, bearing support 178 and the dovetail slide male components 182 which mate with female slide units 112 or 194 of units 184 or 186, respectively.

The unit 184 is the assembled blade clamp support 116 of FIG. 5 with blade 40 and clamp plate 42 secured thereto.

In addition to the blade clamp embodiment of FIG. 5, an alternate one piece molded plastic blade holder 186 is shown which comprises the center raised portion 190, pull tab extension 192, and dovetail components 194. In this embodiment, the blade may be bonded to the plastic and the unit may be thrown away when the edges begin to dull.

While the following specifications are not to be deemed limiting, they describe the preferred way of constructing the cages for the embodiments described herein. At the apexes 65 of the various hair cutter cages, both the upwardly and downwardly extending tine wire forms a 40° angle with the horizontal bisector of the angle. The tine wire which has been found preferably is 0.028 inches in diameter. The blade 40 itself is positioned to bisect the angle of the apexes 65 since were it otherwise, uniform operation would not be achieved when first one side and then the other side of the cutter are held facing the scalp during hair cutting. Inwardly bent portions 67 of the tines have included angles of approximately 90° to provide clearance paths for the hair, thus permitting free unimpeded movement of hair during stroking or combing.

By utilizing the double spine construction and making the spines integral with each other and/or with other portions of the frame, heretofore unachievable rigidity in the tines is obtained. This strength and rigidity is further increased by utilizing helical or otherwise continuous wire strands in the construction of the hair cutter. Thus, a more durable hair cutter results and deformation from dropping is minimized and for practical purposes eliminated.

While various embodiments of the invention have been shown and described, it will be understood that various modifications may be made. The appended claims, therefore, are intended to define the true scope of the invention.

We claim:

1. A hair cutter comprising:

blade support means for supporting a hair cutting blade in a laterally disposed series of selectable hair cutting positions including bearing structure to longitudinally restrain said blade support means;

frame-like structure compatible with said bearing structure;

a cage attached to said frame-like structure;

guide means by which said blade is longitudinally movable with respect to said blade support means; and driving means engaging said blade support means for producing lateral movement with respect to said frame-like structure to the selectable hair cutting positions.

2. The hair cutter of claim 1 wherein said guide means comprises a blade clamp support upon which said blade is mounted.

3. The hair cutter of claim 2 wherein said guide means further comprises compatible guiding structure between said blade clamp support and said blade support means.

4. A hair cutter comprising:

blade supporting means for support a hair cutting blade in a series of selectable hair cutting positions;

guide means by which said blade is slidable longitudinally with respect to said blade support means;

frame-like structure formed into first and second spines respectively positioned above and below said hair cutting blade each of said spines having guiding means for said blade support means;

a cage attached to said first and second spines; and means for driving said blade support means laterally with respect to said frame-like structure including a drive means, and an element pivotally secured to said blade support means and which includes a driven means, so arranged as to provide increased lateral motion of said blade support means.

5. The hair cutter of claim 4 further including a handle in which said element is pivotally mounted within said handle and said driven means is an internal curvilinear rack.

6. A hair cutter comprising:

a blade carrier for supporting a hair cutting blade in a laterally disposed series of selectable hair cutting positions, said blade carrier having bearing structure extending laterally across said blade carrier;

a frame to which said blade carrier is secured, said blade carrier being restrained to permit lateral movement only in relation to said frame, said frame having a bearing surface extending laterally with respect to said frame to be compatible with said bearing structure of said blade carrier;

a protective cage attached to said frame in which said blade carrier is positioned;

driving means engaging said blade carrier for producing lateral movement thereof with respect to said frame to the series of selectable hair cutting positions; and means for mounting said blade on said blade carrier for relative longitudinal movement of said blade with respect to said bladecarrier.

7. The hair cutter of claim 6 wherein said means for mounting said blade comprises a blade clamp support; and said blade clamp support and said blade carrier have compatible structure for the relative longitudinal movement betwen said blade and said blade carrier.

8. The hair cutter of claim 7 wherein said compatible structure comprises dovetail components on said blade carrier and said clamp support.

9. The hair cutter of claim 8 wherein said blade clamp support has a pull tab attached thereto.

10. The hair cutter of claim 9 wherein said blade is held to said blade clamp support by means of a clamp member.

11. The hair cutter of claim 6 wherein said blade carrier has a width smaller than the width of said cutting blade.

12. A hair cutter comprising:

a blade carrier for supporting a hair cutting blade in a laterally disposed series of selectable hair cutting positions;

a frame to which said blade carrier is adjustably secured including a first and second portion of said frame above and below said hair cutting blade;

a first bearing surface formed as part of said first portion of said frame to guide a part of said blade carrier;

a second bearing surface formed as part of said second portion of said frame to guide a part of said blade carrier;

a cage attached to said first and second portions;

means for mounting said blade for longitudinal movement with respect to said blade carrier; and driving means engaging said blade carrier for producing lateral movement thereof with respect to said frame to selectable hair cutting positions.

* * * * *